United States Patent [19]

Arai et al.

[11] Patent Number: 4,809,311

[45] Date of Patent: Feb. 28, 1989

[54] X-RAY DIAGNOSTIC APPARATUS

[75] Inventors: Eiichi Arai; Keisuke Mori, both of Kyoto; Takao Makino, Otsu, all of Japan

[73] Assignee: Kabushiki Kaisha Morita Seisakusho, Kyoto, Japan

[21] Appl. No.: 40,355

[22] Filed: Apr. 17, 1987

[30] Foreign Application Priority Data

Apr. 18, 1986 [JP] Japan ..... 61-090293

[51] Int. Cl.[4] ..... H05G 1/34

[52] U.S. Cl. ..... 378/110; 378/109; 378/112

[58] Field of Search ..... 378/109, 110, 111, 112, 378/114

[56] References Cited

U.S. PATENT DOCUMENTS 4,322,625 3/1982 Daniels et al. ..... 378/110

4,346,297 8/1982 Suzuki et al. ..... 378/110

*Primary Examiner*—Carolyn E. Fields

*Assistant Examiner*—David P. Porta

*Attorney, Agent, or Firm*—Koda and Androlia

[57] ABSTRACT

A pre-ignition type X-ray apparatus including a mode changeover switch which changes a pre-heat mode to an X-ray irradiation mode and vice versa, a tube current control circuit for feedback control of the X-ray tube's filament heating current to a target value, and pre-heat control circuit for controlling the filament heating current in the pre-heat mode to a target value lower than the target value in the X-ray irradiation mode. The pre-heat control circuit includes a differential amplifier which amplifies the difference between the detected voltage corresponding to a source voltage and the reference voltage determining the lower target value, so that the control signal is outputted from the differential amplifier.

10 Claims, 3 Drawing Sheets

OUTPUT FROM PRE-HEAT CONTROL CIRCUIT
(OUTPUT FROM DIFFERENTIAL AMPLIFIER)

X-RAY DIAGNOSTIC APPARATUS

BACKGROUND OF THE INVENTION

1. Field of the Invention

The present invention relates to an improvement of an X-ray diagnostic apparatus of pre-ignition type.

2. Prior Art

The X-ray diagnostic apparatus of the pre-ignition type has been developed for enabling irradiation of stabilized intensity and for preventing delay in the rise of the tube current at the time of start of X-ray irradiation as well as for preventing over-shooting by heating the filament of the X-ray tube prior to impressing a source voltage between the anode and cathode of the X-ray tube.

This kind of X-ray diagnostic apparatus for pre-ignition type always need stable rise of the X-ray regardless of fluctuations in the source voltage. To meet this need, the electric power is supplied from a DC power source through an inverter to the primary winding of the filament transformer, and also from another DC power source through another inverter to the primary winding of the high-voltage transformer of the high-voltage generating circuit of a conventional apparatus, to thereby prevent fluctuations in the power supply to the primary windings of the transformers.

For instance, an apparatus for effectively preventing another problem of the X-ray diagnostic apparatus of the pre-ignition type, that is, overshoot which is apt to be generated during the rise of the tube current, has been disclosed in Japanese Laid-Open Patent Publication (Kokai) No. 57-13700 by the present inventor. In this invention, a DC stabilized power source circuit and inverter are provided to prevent fluctuations in the power supply to the primary winding of the transformer and another DC stabilized power source circuit and another inverter are also provided to prevent fluctuations in the power supply to the primary winding of the side-voltage transformer, regardless of fluctuations of the source voltage.

As described above, the conventional X-ray diagnostic apparatus of the pre-ignition type is provided with two DC stabilized power source circuits and two inverters to cope with fluctuations in the power supply. This results in a complicated structure and high manufacturing costs; thus there is room for improvement.

SUMMARY OF THE INVENTION

The present invention has been made as a solution of the above-mentioned prior art and is aimed at providing an X-ray diagnostic apparatus without any DC stabilized power source, simple in construction and not adversely influenced by source voltage fluctuations.

The present invention, proposed for accomplishing the above mentioned object, relates to an improved X-ray diagnostic apparatus for pre-ignition type, to a pre-heat control circuit in particular, and is characterized generally in that the difference between the detected signal corresponding to the source voltage supplied to the X-ray tube and the pre-heat reference signal lower than the preset level is amplified to form a pre-heat control signal.

BRIEF DESCRIPTION OF THE DRAWINGS

An embodiment of the present invention is described below with reference to the annexed drawings wherein.

DETAILED DESCRIPTION OF THE INVENTION

Figure 1:
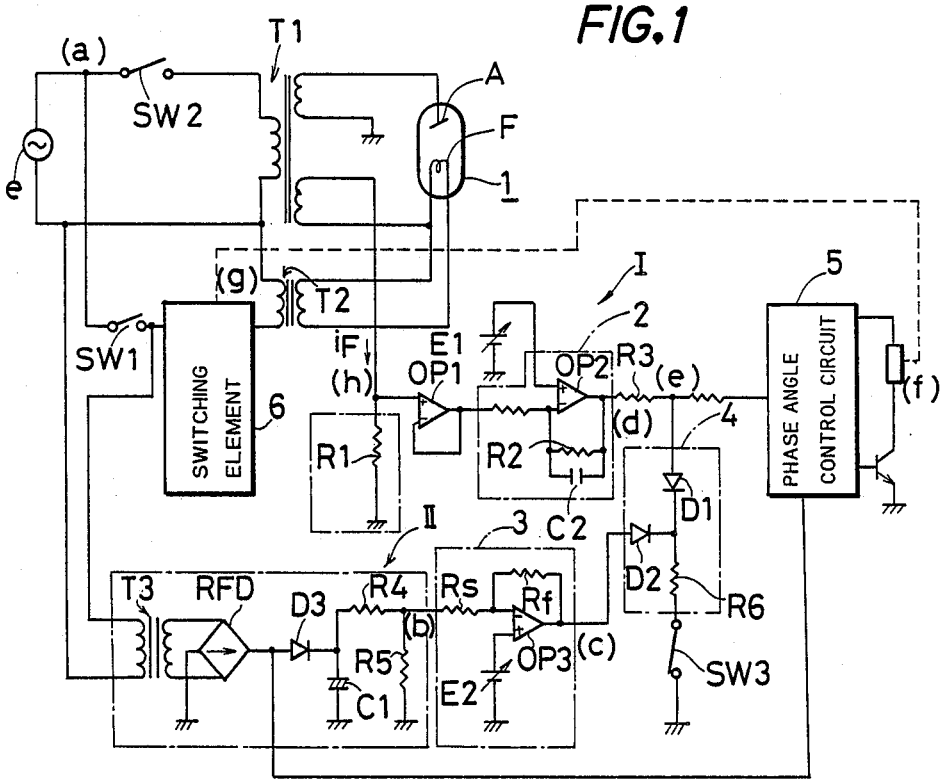
FIG. 1 is a circuit diagram of an embodiment of the invention.

FIG. 1 is a circuit diagram showing an embodiment of the present invention.

In the drawing, reference numeral 1 is an X-ray tube comprising a filament F and an anode A. T1 is a high voltage transformer, and the commercial power source "e" is boosted and supplied to the X-ray tube 1. Since such a high voltage transformer T1 is used as a normal boosting transformer, except to make the tube voltage constantly supplied to the X-ray tube 1, a fixed voltage transformer may be used as well.

A high voltage transformer T1 comprises a primary coil connected to the power source "e" and two secondary coils connected to the filament F and the anode A of the X-ray tube 1.

A tube current control circuit I is connected to the secondary coil on the filament F side of the high voltage transformer T1, and to the primary side of the high voltage transformer T1 is connected the primary current control circuit II via a switch SW1 and a step-down transformer T3. T2 is a filament transformer, which is connected in parallel to the high voltage transformer T1, and through switching control by means of a switching element 6 provided on the primary coil side, the voltage induced in the secondary coil is phase-controlled.

Switch SW1 is the pre-heat switch, switch SW2 is an X-ray irradiation switch and switch SW3 is interlocked with the X-ray irradiating switch SW2. All these switches SW1, SW2 and SW3 are mode changeover switches. The tube current control circuit I is the so-called feedback control circuit. During X-ray irradiation it detects as a feedback signal the tube current iF flowing through the X-ray tube 1, compares it with a preset reference voltage E1 and integrates the difference to output a feedback control signal Vd.

In the above embodiment, a tube current iF of the X-ray tube 1 is converted into a voltage signal Vh by means of a monitor resistance R1 connected to the secondary coil of the high voltage transformer T1, and then the picked up signal Vh is sent to an integration circuit 2 and the difference from the reference voltage E1 is integrated to obtain the control signal Vd.

The integration circuit 2 is composed of an operational amplifier OP2 and an integration capacitor C2, and the control target for the tube current iF is set by means of a reference voltage E1 connected to the non-reversible input terminal of the operational amplifier OP2, and between a monitor resistance R1 and the integration circuit 2 is provided with a buffer amplifier OP1 composed of voltage follower/s. A resistor R2, together with the input resistor determines the DC amplitude.

The pre-heat control circuit II is for taking out the source voltage "e" lowered by a step-down transformer T3 and having passing through a bridge rectifier RED, a rectifying diode D3 and a smoothening capacitor C1 as a DC voltage free of pulsation, and this DV voltage divided by a potential division circuit consisting of resistors R4 and R5, a detected voltage Vb corresponding to the source voltage "e" is obtained. This detected voltage Vb is inputted into a differential amplifier 3, in which the difference between the detected voltage Vb and a reference voltage E2, which is set smaller than the reference voltage E1 of the integration circuit 2 and determines the control target value for the pre-heat control, is amplified by the predetermined degree of amplitude to obtain a control signal Vc.

Figure 4:
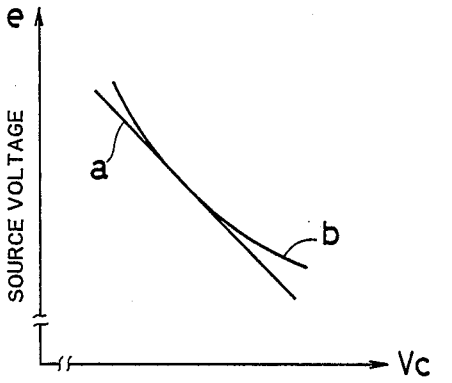
FIG. 4 shows the output characteristics of the pre-heat control circuit in relation to source voltage.

With a differential amplifier 3 which is disclosed in the embodiment, the reference voltage E2, resistor Rs and Rf are set at the proper levels so that approximate linear output characteristics are obtained as shown in FIG. 4, but in order to control the power to the filament at a predetermined level and to obtain smoother starting characteristics it is still better if the characteristics of the filament is taken into consideration and a non-linear element (e.g. a combination of resistance and diode) is formed through a combination of the resistors Rs and Rf so that, as shown as "b" in FIG. 4, a non-linear output characteristic is obtained.

Reference numeral 4 is a selectable circuit formed by connecting the cathodes of diodes D1 and D2 (in common).

During the pre-heat mode, the output from the pre-heat control circuit II is outputted to a phase angle control circuit 5, while during the X-ray irradiation mode the output from the tube current control circuit II is outputted to the phase angle control circuit 5. The anode of the diode D1 is connected to the output end of the tube current control circuit I over the resistor R3, while the anode of the diode D2 is connected to the output end of the pre-heat control circuit II respectively, and the cathodes of the diodes D1 and D2 commonly connected are grounded over the resistor R6 and mode changeover switch SW3, while the anode of the diode D1 is connected to the phase angle control circuit 5.

The phase angle control circuit 5 regulates the ON timing of the switching element 6 corresponding to a level of a control output voltage Ve which is inputted by a selective action of the selecting circuit 4, and the firing angle $\theta$ is controlled such that the voltage Vg supplied to the filament F is increased as the level of its control output voltage Ve is increased. This control is the so-called phase angle-control and switching-regulates the supply power to the filament F. To such known trigger pulse generation means by the use of firing element such as PUT, UJT, etc. are applicable. Also, the switching element 6 controlled by switching by means of output pulse Vf of the phase angle control circuit 5, it is needless to say that the known power switching element formed through the combination of Triac, pulse transformer etc. is applicable.

The action of the present invention will be described with the above-mentioned embodiment as the basis.

Figure 2:
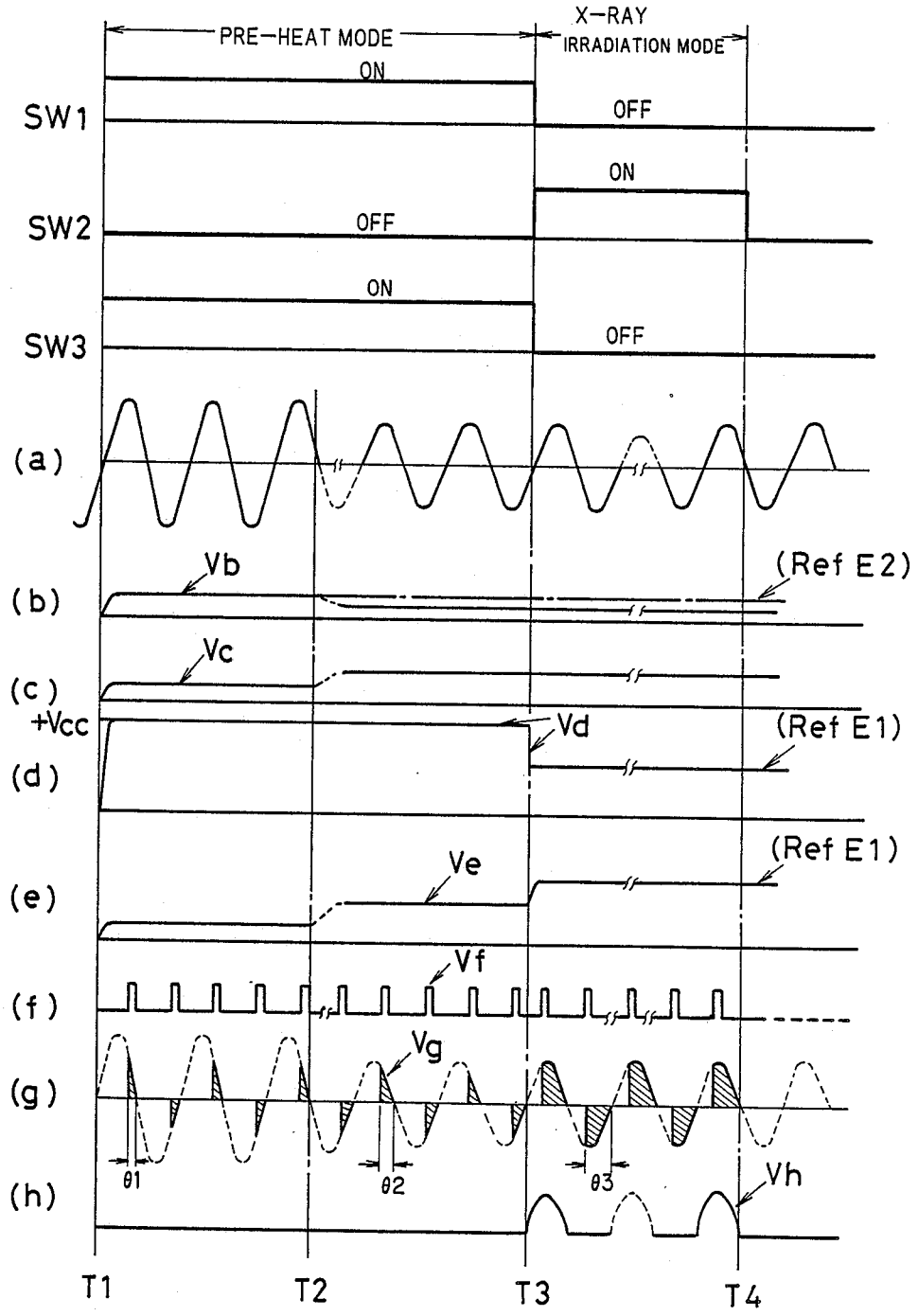
FIG. 2 is a time chart showing the action of each functional part.
Figure 3:
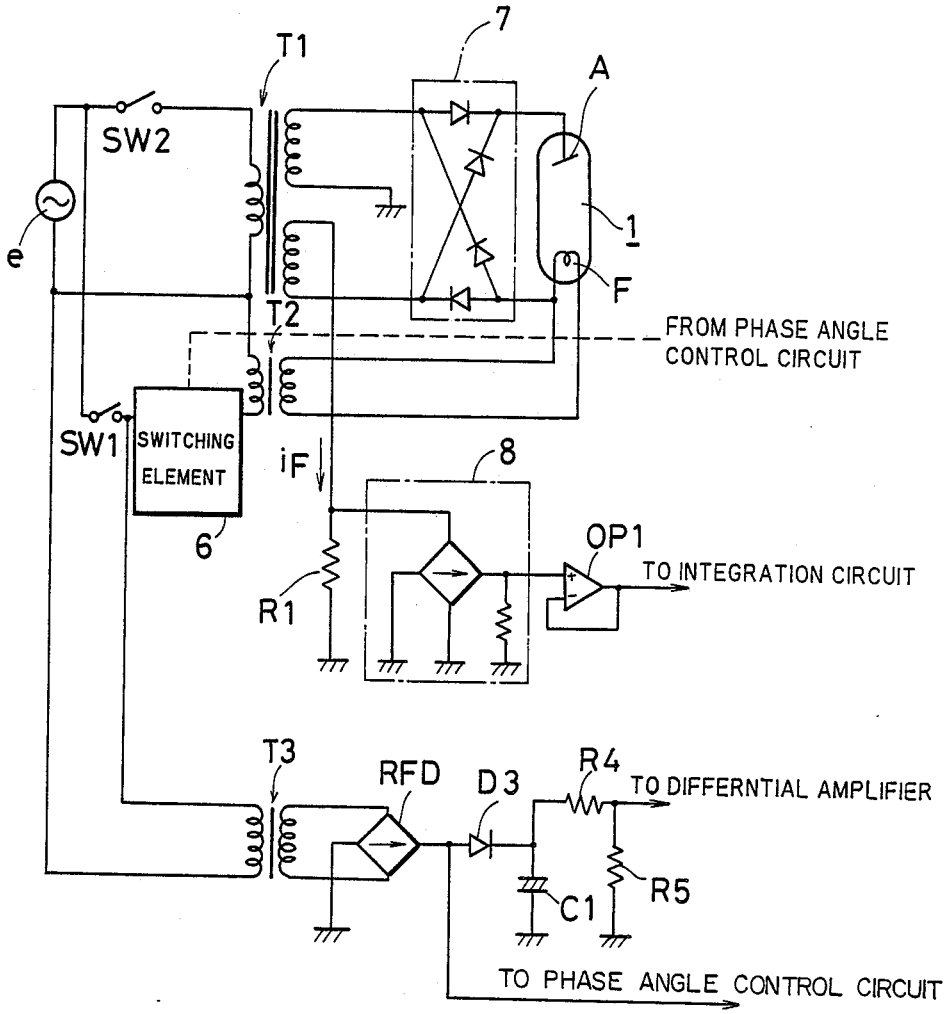
FIG. 3 is a structural view of the essential parts of another embodiment.

Symbols "a"-"h" of FIG. 2 denote charts corresponding to the same ("a"-"h") of FIG. 1.

When the power source switch (not shown) is turned ON, the switch SW1 turned ON.

Since the switch SW3 is normally OFF even at this point of time so as to keep both the tube current control circuit I and the pre-heat control circuit II continuative, the source voltage "e" is not applied and hence it is in the pre-heat mode.

Since in this pre-heat mode the tube current iF, the output of the integration circuit 2 is saturated level, that is, the drive power source level (the drive power source level of the operational amplifier OP2 of drive power source level +Vcc) of the integration circuit 2 is raised.

Meanwhile, in the pre-heat control circuit II, the detected voltage Vb at a level corresponding to the source voltage "e" is inputted to a differential amplifier 3 so that its output Vc is at a level when the differential between the reference voltage E2 and the detected voltage Vb is multiplied by the predetermined degree of amplification (the level when there is no fluctuation of the source voltage is shown in FIG. 2 by the reference numeral E2).

Then the output level Vc of the pre-heat control circuit II is lower than the output level Vd of the tube current control circuit I, hence the diode D1 of the selecting circuit 4 is in the state of "continuity". As a result, the control output voltage Ve inputted to the phase angle control circuit 5 is lowered to the level Vc approximately the same as the output level of the pre-heat control II, hence the switching element 6 is triggered at the phase corresponding to the output level Vc(Ve=Vc) of the pre-heat control circuit II, and the filament heating voltage Vg is impressed to the filament transformer T2. Under such condition, however, fluctuation results in the source voltage, and if it is allowed to increase, the level of the control output voltage Ve sent to the phase angle control circuit decreases since the output of the differential amplifier 3 is equivalent to the reference voltage E2 and detected voltage Vb, the generation timing of the output pulse Vf of the phase angle control circuit is delayed, and the firing angle of the filament heating voltage due to the switching element 6 is reduced. That is, if the firing angle of the filament heating voltage Vg is reduced to compensate for an increase of the source voltage "e", it is so controlled that the effective filament heating current is increased.

Since the source voltage "e" fluctuates to become lower, the output of the difference amplifier 3 is increased, hence the level of the control output voltage Ve sent to the phase angle control circuit 5 is raised, the generation timing of the output Vf is increased and the firing angle due to the switching element 6 is increased (In FIG. 2, $\theta 1<\theta 2<\theta 3$). This means that the firing angle of the filament heating voltage Vg which compensates the source voltage is increased.

As a result of the above-mentioned action the filament heating current is stabilized at a given level well compensating for the fluctuations of the source voltage during the pre-heat mode and the uprise of the tube current is smooth at the time of X-ray irradiation after completion of the pre-heating.

Upon completion of the pre-heat mode as described above, it is followed by the X-ray irradiation mode. This is, the switch SW2 is turned ON, and simultaneously the mode changeover switch SW3 becomes OFF. Since, as a result, the diodes D1 and D2 come to be non-continuity, the pre-heat control circuit II is cut from the phase control circuit 5, and the output Vd (Ve=Vd) of the tube current control circuit I is inputted to the phase angle control circuit 5.

In the tube current control circuit I, the difference between the detected voltage VF corresponding to the tube current iF and the reference signal E1 is integrated and its output is taken as a control signal, hence when the stabilized region has been reached, it is controlled at a given level determined by the reference voltage E1 (shown as reference numeral E1 in FIG. 2), and thus an X-ray of a stabilized intensity is radiated. FIG. 2 is a time chart showing the response of the individual parts in event of lowering of the source voltage, and the reverse is true in the event of rising of the same.

Table 3 is a block diagram showing another embodiment of the present invention.

The feature of this embodiment is that the source voltage supplied to the X-ray tube 1 is full-wave rectified by a full-wave rectifying circuit 7. The alternate portion detected by the monitor resistance R1 is further full-wave rectified by a bridge rectifier 8, and the current thus rectified is inputted to the integration circuit composing the tube current control circuit I. The rest of the structure is the same as the circuit of FIG. 1, hence the corresponding parts are referred to by the same reference numerals with further explanation eliminated.

Although the tube current control circuit of the present invention shown in its embodiment is composed of an integration circuit, it is needless to say that the invention is not limited thereby or thereto.

As will be well understood from the above explanation, according to the present invention it is possible to provide a composition safe from adverse influences by fluctuation of source voltage, and it is thus possible to provide an X-ray diagnostic apparatus simple in construction, inexpensive and high in practical value.

We claim:

1. A pre-ignition type X-ray diagnostic apparatus comprising a mode changeover switch which enables switching between a pre-heat mode and an X-ray irradiation mode, a tube current control circuit for feedback control of an X-ray tube's filament heating current to a target value, and a pre-heat control circuit for controlling said filament heating current in said pre-heat mode to a target value lower than the target value in said X-ray irradiation mode, characterized in that said pre-heat control circuit comprises a differential amplifier which amplifies the difference between a detected voltage corresponding to a source voltage and a reference voltage corresponding to said lower target value, so that the control signal is outputted from said differential amplifier.

2. A pre-ignition type X-ray diagnostic apparatus according to claim 1, wherein said tube current control circuit is coupled in its feedback system with an integration circuit which integrates the difference between the detected voltage taken out as a voltage value for the X-ray tube's filament heating current and a reference voltage corresponding to said target value.

3. A pre-ignition type X-ray diagnostic apparatus according to claim 1 or 2, wherein said pre-heat control circuit is connected to a phase angle control circuit which receives the output from said differential amplifier which varies with fluctuation of the source voltage and to a power switching element which controls by switching the voltage supplied to the filament.

4. A pre-ignition type X-ray apparatus according to claim 1 or 2, wherein said differential amplifier is composed of non-linear elements.

5. A pre-ignition type X-ray apparatus according to claim 1 or 2, wherein included are a full-wave rectifying circuit for full-wave rectifying the source voltage supplied to said X-ray tube and a bridge rectifier for full-wave rectifying the voltage taken out corresponding to said filament heating current.

6. A pre-ignition type X-ray diagnostic apparatus according to claim 2, wherein said integration circuit comprises an operational amplifier and an integration capacitor and to a non-reversible input terminal of the operational amplifier is inputted a reference voltage and to a reversible input terminal thereof is inputted a detected voltage.

7. A pre-ignition type X-ray apparatus according to claim 3, wherein said differential amplifier is composed of non-linear elements.

8. A pre-ignition type X-ray apparatus according to claim 3, wherein included are a full-wave rectifying circuit for full-wave rectifying the source voltage supplied to said X-ray tube and a bridge rectifier for full-wave rectifying the voltage taken out corresponding to said filament heating current.

9. A pre-ignition type X-ray apparatus according to claim 4, wherein included are a full-wave rectifying circuit for full-wave rectifying the source voltage supplied to said X-ray tube and a bridge rectifier for full-wave rectifying the voltage taken out corresponding to said filament heating current.

10. A pre-ignition type X-ray apparatus according to claim 7, wherein included are a full-wave rectifying circuit for full-wave rectifying the source voltage supplied to said X-ray tube and a bridge rectifier for full-wave rectifying the voltage taken out corresponding to said filament heating current.

* * * * *